US011639264B1

(12) United States Patent
Odariko et al.

(10) Patent No.: US 11,639,264 B1
(45) Date of Patent: May 2, 2023

(54) TRASH COMPACTION AND SANITATION RECEPTACLE AND METHOD OF USE

(71) Applicants: Farouk Odariko, Houston, TX (US); Abdul D. Odariko, Houston, TX (US)

(72) Inventors: Farouk Odariko, Houston, TX (US); Abdul D. Odariko, Houston, TX (US)

( * ) Notice: Subject to any disclaimer, the term of this patent is extended or adjusted under 35 U.S.C. 154(b) by 0 days.

(21) Appl. No.: 17/537,092

(22) Filed: Nov. 29, 2021

(51) Int. Cl.

| | |
|---|---|
| ***B30B 5/02*** | (2006.01) |
| ***B65F 1/14*** | (2006.01) |
| ***B65F 1/06*** | (2006.01) |
| ***B65F 1/16*** | (2006.01) |
| ***B65F 7/00*** | (2006.01) |

(52) U.S. Cl.
CPC ..... *B65F 1/1405* (2013.01); *B30B 5/02* (2013.01); *B65F 1/06* (2013.01); *B65F 1/1473* (2013.01); *B65F 1/16* (2013.01); *B65F 7/00* (2013.01); *B65F 2001/1653* (2013.01); *B65F 2210/129* (2013.01); *B65F 2210/162* (2013.01); *B65F 2210/168* (2013.01); *B65F 2210/184* (2013.01)

(58) Field of Classification Search
CPC ..... B30B 1/30; B30B 5/02; B30B 9/22; B65F 1/1405; B65F 1/141; B65F 1/1415; B65F 1/1452; B65F 1/06; B65F 1/1473; B65F 1/16; B65F 7/00; B65F 2001/1653; B65F 2210/129; B65F 2210/162; B65F 2210/168; B65F 2210/184
See application file for complete search history.

(56) References Cited

U.S. PATENT DOCUMENTS

| | | | | |
|---|---|---|---|---|
| 5,222,704 | A * | 6/1993 | Light | B65F 1/06 220/495.08 |
| 2008/0053318 | A1* | 3/2008 | van Beuningen | B30B 9/3053 100/226 |
| 2012/0060706 | A1* | 3/2012 | Brown | B65F 1/1646 100/211 |
| 2019/0382197 | A1* | 12/2019 | Li | B65F 1/1415 |
| 2020/0339344 | A1* | 10/2020 | Wang | B65F 1/1426 |

FOREIGN PATENT DOCUMENTS

| | | | | |
|---|---|---|---|---|
| KR | 102124821 B1 * | 6/2020 | | B65F 1/06 |
| WO | WO-2019186745 A1 * | 10/2019 | | B65F 1/06 |

* cited by examiner

*Primary Examiner* — Jimmy T Nguyen
(74) *Attorney, Agent, or Firm* — Leavitt Eldredge Law Firm

(57) ABSTRACT

A trash compactor and sanitation receptacle includes a housing defining an interior cavity therein; a lid; one or more wheels; a display; a camera; a compaction system having four movable members, a first set of railings, a second set of railings, a first set of vertical lift tracks, and a second set of vertical lift tracks; a fumigation system; a sanitation system; a sealing system; a controller; a power switch; and a power source.

2 Claims, 5 Drawing Sheets

TRASH COMPACTION AND SANITATION RECEPTACLE AND METHOD OF USE

BACKGROUND

1. Field of the Invention

The present invention relates generally to trash disposal systems, and more specifically to a trash compaction and sanitation receptacle that provides for clean and efficient trash disposal.

2. Description of Related Art

Trash disposal systems are well known in the art and are effective means for holding trash and other wastes until permanent disposal. Common trash disposal systems include trash cans that are fitted with disposable plastic bags or liners which can be closed when filled and removed from the trash cans. Generally, waste disposal services will then collect the filled plastic bags and transport them to landfills. Because trash is typically bulky, users often will compact trash prior to or after discarding trash into plastic bags to make additional space for more trash to be collected therein.

One of the problems commonly associated with conventional trash disposal systems is their limited efficiency. For example, conventional trash cans are often emptied after the plastic bags become overloaded with trash. In addition, as more trash accumulates within the plastic bags, odors generated from the trash are compounded, creating an unpleasant environment for individuals in close proximity. Further, the compounded odors often linger even after filled plastic bags are removed, leading to health issues as a result of prolonged exposure.

Accordingly, although great strides have been made in the area of trash disposal systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
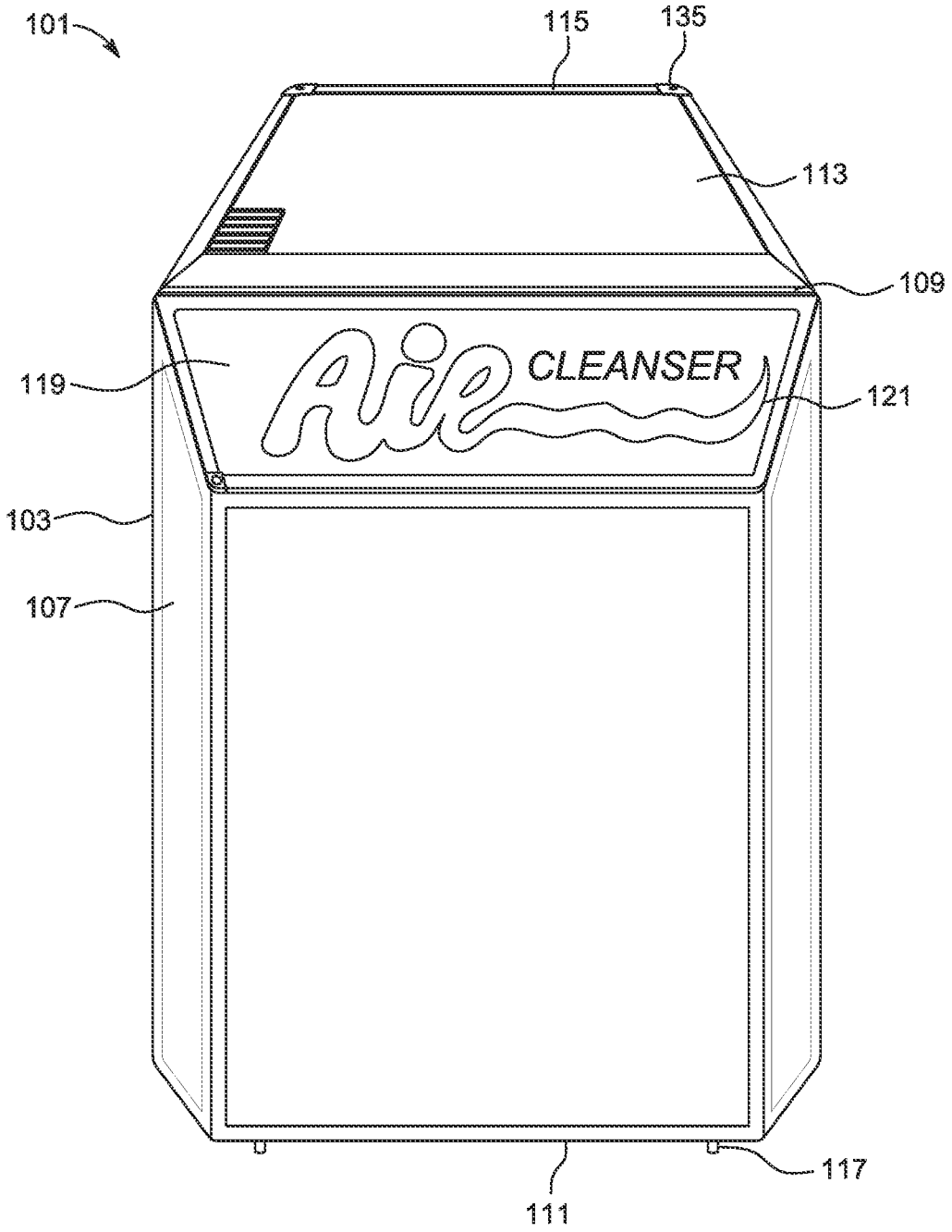
FIG. 1A is a front perspective view of a trash compaction and sanitation receptacle in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional trash disposal systems. Specifically, the present invention provides for a trash receptacle capable of compacting and sanitizing trash contained within a disposable container. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
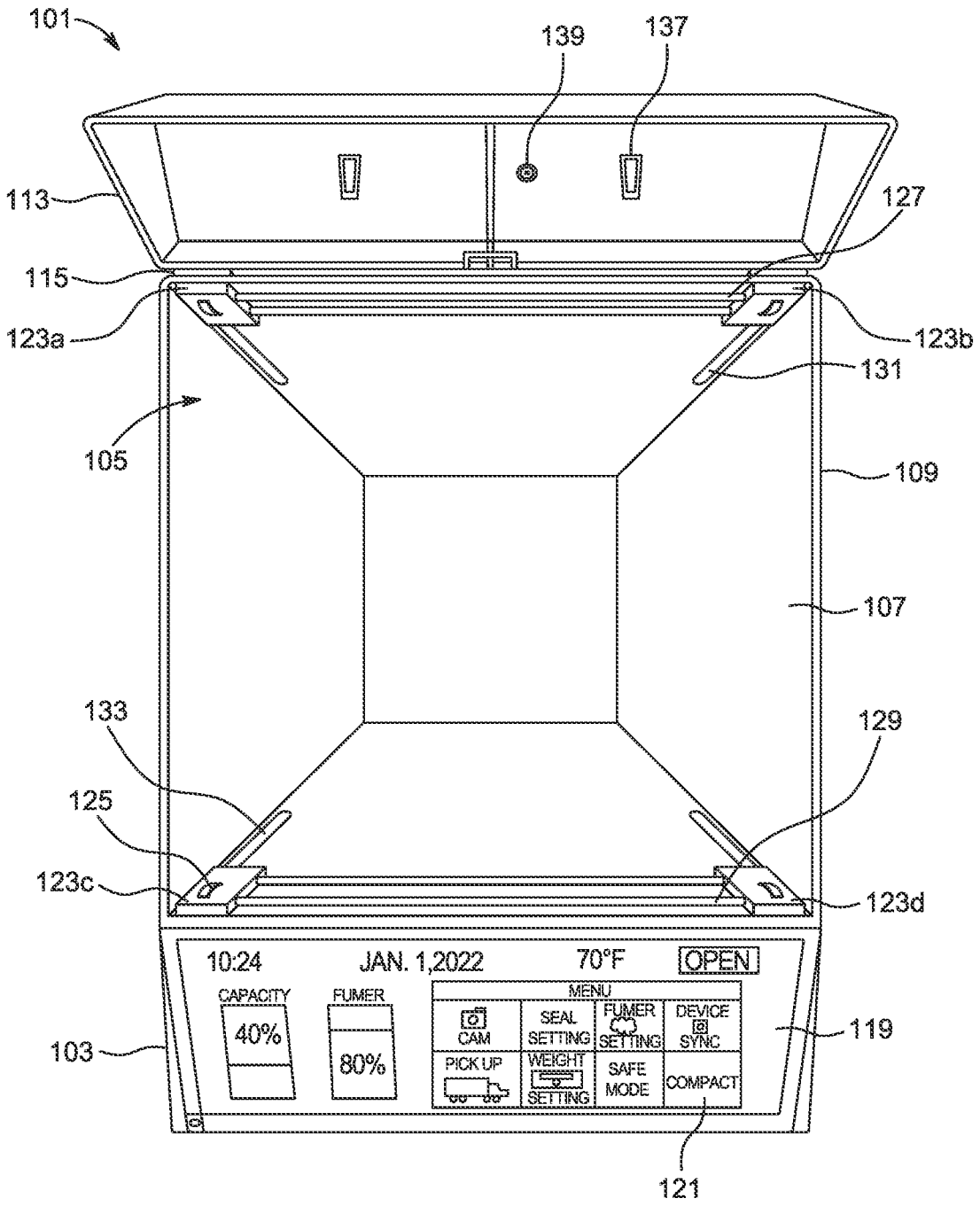
FIG. 1B is a top perspective view of the trash compaction and sanitation receptacle of FIG. 1, with a lid oriented in an open position.

Referring now to the drawings wherein like reference characters identify corresponding or similar elements throughout the several views, FIGS. 1A and 1B depict various views of a trash compaction and sanitation receptacle 101 in accordance with a preferred embodiment of the present application. It will be appreciated that the receptacle 101 overcomes one or more of the above-listed problems commonly associated with conventional trash disposal systems.

In the contemplated embodiment, the receptacle 101 includes a generally rectangular housing 103 defining an interior cavity 105 therein. The housing 103 includes one or more sidewalls 107, an open top portion 109, and a closed bottom portion 111. It should be appreciated that the housing 103 can be substantially composed of steel, aluminum, plastic or any other suitable material. In alternative embodiments, the housing 103 can have any other suitable configuration, i.e., polygonal, triangular, square, oval, or other suitable geometry.

The receptacle 101 also includes a lid 113 coupled to the open top portion 109 via one or more hinges 115 and one or more wheels 117 coupled to the closed bottom portion 111. The one or more wheels 117 provide for easy transportation.

The receptacle 101 also includes a display 119 coupled to the housing 103. The display 119 allows a user to interact with a graphical user interface 121 to view and control various settings of the receptacle 101. It should be appreciated that the display 119 can vary in location on the receptacle. It should also be appreciated that the display 119 can incorporate touch-sensitive technology (also known as a "touch screen" or "touch screen display"). In addition, it should be appreciated that the display 119 can include a plurality of sizes. Further, it should be appreciated that the display 119 can be any screen technology including, without limitation, a cathode ray tube display, an electroluminescent display, a liquid crystal display, a light emitting diode display, organic light emitting diode display, a plasma display, a quantum dot display, or the like.

The receptacle also includes a compaction system configured to condense trash within a trash bag. The compaction system includes four movable members 123*a*-123*d*, wherein one movable member 123 is located at a corner of the open top portion 109 within the interior cavity 105. Each movable member 123 includes a hook 125 coupled thereto. The four hooks 125 are configured to allow a corner of a trash bag 300 (not shown, see FIG. 3) to be hung. The movable members 123*a*, 123*b* are configured to slide along a substantially horizontal axis within the interior cavity 105 via a first set of railings 127. The movable members 123*c*, 123*d* are configured to slide along a substantially horizontal axis within the interior cavity 105 via a second set of railings 129.

The receptacle also includes a first set of vertical lift tracks 131 and a second set of vertical lift tracks 133. The first set of vertical lift tracks 131 are configured to allow movable members 123*a*, 123*b* to slide along a substantially vertical axis within the interior cavity 105. The second set of movable lift tracks 133 are configured to allow the movable members 123*c*, 123*d* to slide along a substantially vertical axis within the interior cavity 105.

The receptacle 101 also includes a plurality of fumigation slots 135 located on the rear end of the lid 113. The fumigation slots 135 are components of a fumigation system 200 (not shown, see FIG. 2 for further discussion).

The receptacle 101 also includes one or more light sources 137 coupled to the underside of the lid 113. The one or more light sources 137 are configured to emit ultraviolet light. In addition, the one or more light sources 137 are components of a sanitation system 201 (not shown, see FIG. 2 for further discussion). It should be appreciated that the one or more light sources 137 can be any light technology capable of emitting ultraviolet light including, without limitation, blacklight blue bulbs, blacklight bulbs, germicidal bulbs, and the like.

The receptacle 101 further includes a camera 139 coupled to the underside of the lid 113. The camera 139 allows a user to view the interior cavity 105 and the contents within a trash bag without having to open the lid 113.

It should be appreciated that the receptacle 101 can vary based on aesthetical, functional, or manufacturing considerations.

Figure 2:
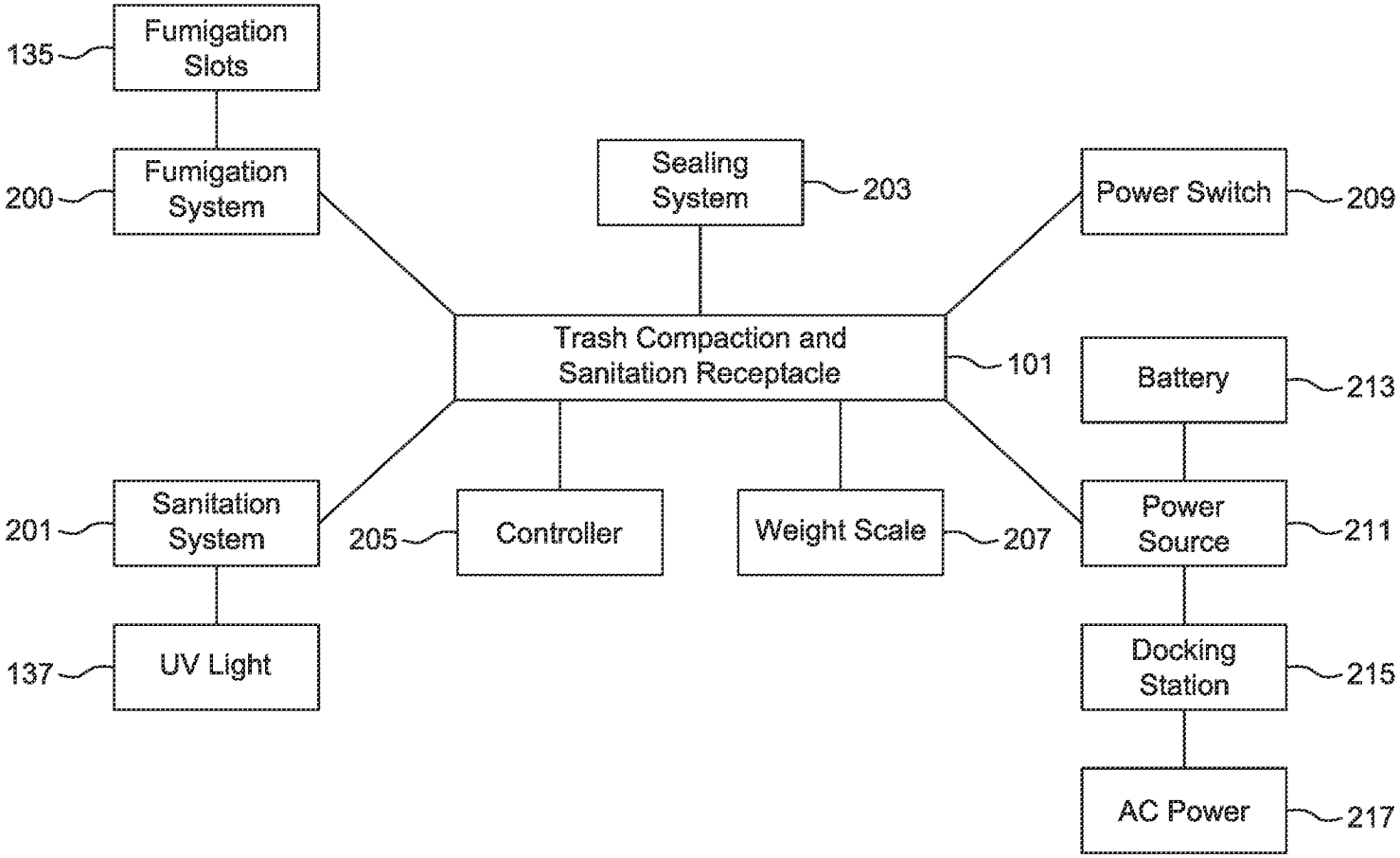
FIG. 2 is a block diagram of features associated with the receptacle of FIGS. 1A and 1B.

Referring now to FIG. 2, a block diagram of features contemplated for the receptacle 101 is illustrated. The receptacle 101 includes a fumigation system 200, a sanitation system 201, a sealing system 203, a controller 205, a weight scale 207, a power switch 209, and a power source 211.

The fumigation system 200 is configured to release a gaseous substance via the fumigation slots 135. It should be appreciated that the gaseous substance can be any composition suitable for reducing microbial agents.

The sanitation system 201 is configured to disinfect the interior cavity 105 via the one or more light sources 137.

The sealing system 203 is configured to securely close a trash bag. In the preferred embodiment, the sealing system 203 uses burn technology to seal the trash bag.

The controller 205 is a microprocessor that manages all operations, detects all inputs, and provides outputs for running the receptacle 101. It should be appreciated that the controller 205 is in electronic communication with the display 119, camera 139, compaction system, fumigation system 200, sanitation system 201, sealing system 203, weight scale 207, power switch 209, and power source 211.

The weight scale 207 is configured to measure the load exerted by a trash bag when the trash bag is hung on the hooks 125. The weight scale 207 may send a signal to the controller 203 that the load exerted by the trash bag has reached maximum load capacity.

The power switch 209 is configured to turn the receptacle 101 on and off.

The power source 211 is configured to supply electrical energy to the receptacle 101. The power source 211 can be a battery 213 that is rechargeable. In the preferred embodiment, the battery 213 based on lithium-ion technology. In addition, the battery 213 can be recharged through a docking station 215 that is in direct connection to an alternating current (AC) power 217.

Figure 3:
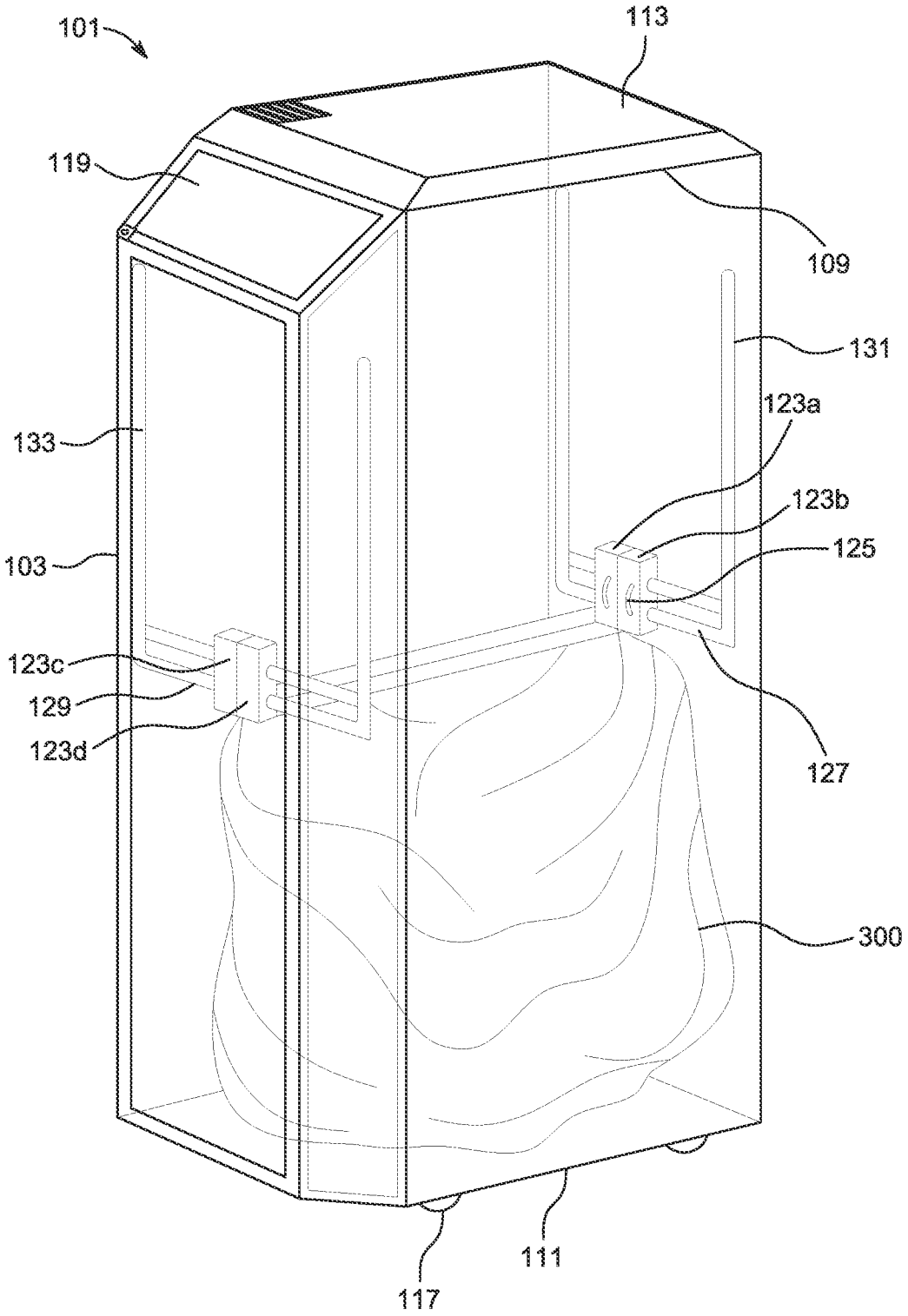
FIG. 3 is a perspective view of the receptacle of FIGS. 1A and 1B, illustrating a trash bag being compacted within the interior cavity.

Referring now to FIG. 3, a perspective view of the receptacle 101 compacting a trash bag 300 within the interior cavity 105 is depicted. As shown, the movable members 123*a*-123*d* compact the trash bag 300 via their respective railings 127, 129 and vertical lift tracks 131, 133.

It should also be appreciated that one of the unique features believed characteristic of the present application is that the receptacle 101.

Figure 4:
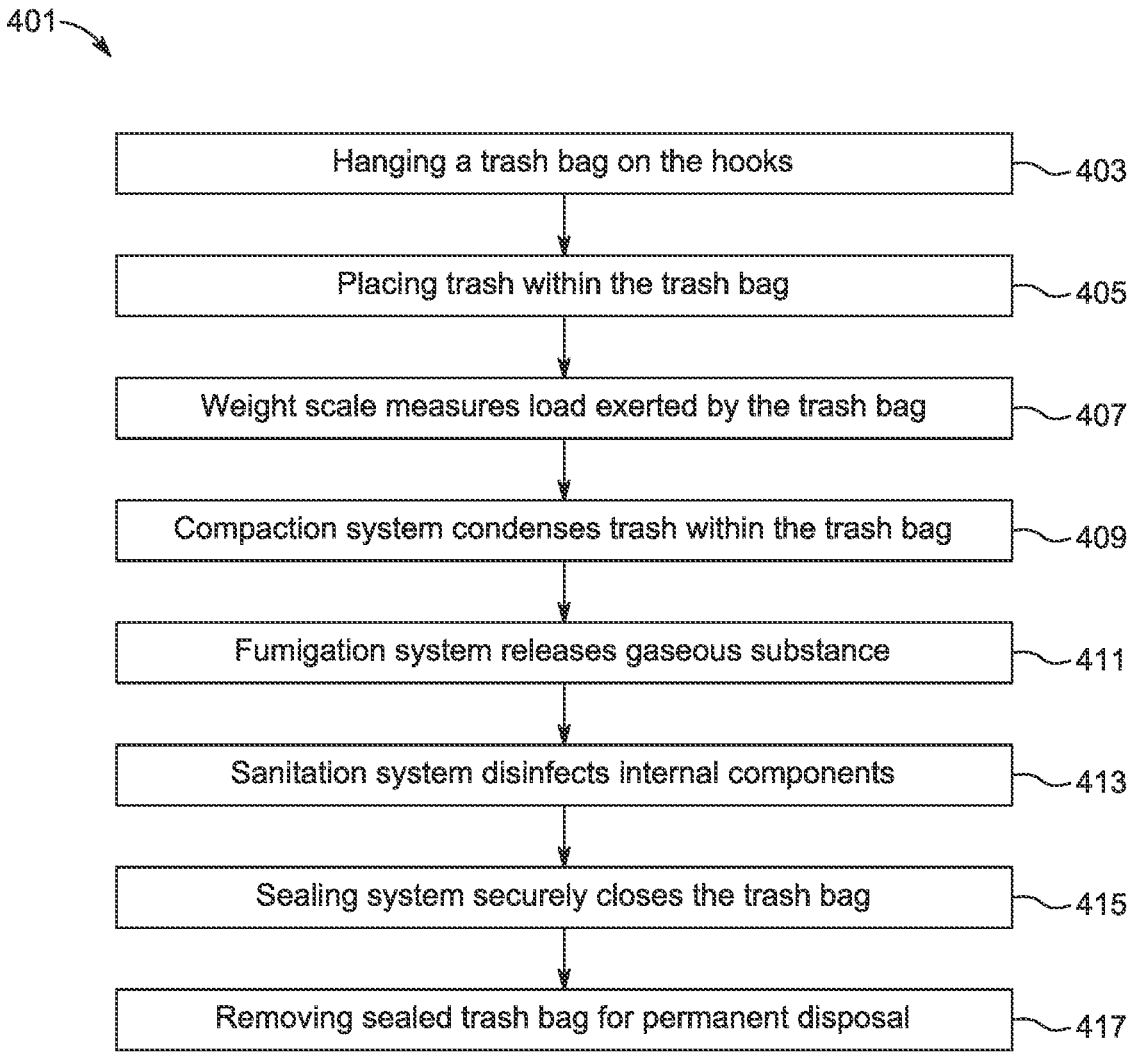
FIG. 4 is a flowchart of a method of use of the receptacle of FIGS. 1A and 1B.

In FIG. 4, a flowchart 401 depicts a simplified method of operation associated with the receptacle 101. During use, when a trash bag on the hooks, a user may place trash within the trash bag as shown with boxes 403, 405. The weight scale measures the load exerted by the trash bag, as shown with box 407. The trash is condensed via the compaction system, as shown with box 409. The fumigation system releases a gaseous substance, as shown with box 411. The sanitation system disinfects the interior cavity, the trash, and the trash bag, as shown with box 413. When the sealing system securely closes the trash bag, the user may remove the sealed trash bag for permanent disposal, as shown with boxes 415, 417.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A trash compaction and sanitation receptacle, comprising:

a housing defining an interior cavity therein, the housing having:

a plurality of side walls;

an open top portion; and a closed bottom portion;

a lid coupled to the open top portion via one or more hinges;

one or more wheels coupled to the closed bottom portion;

a display configured to display a graphical user interface;

a camera coupled to an underside of the lid;

a compaction system configured to condense trash within a trash bag, the compaction system having:

a first movable member coupled to a first corner of the open top portion, the first movable member having a first hook coupled thereto;

a second movable member coupled to a second corner of the open top portion, the second movable member having a second hook coupled thereto;

a third movable member coupled to a third corner of the open top portion, the third movable member having a third hook coupled thereto; and a fourth movable member coupled to a fourth corner of the open top portion, the fourth movable member having a fourth hook coupled thereto;

wherein the first and second movable members are configured to slide along a horizontal axis within the interior cavity via a first set of railings;

wherein the first and second movable members are configured to slide along a vertical axis within the interior cavity via a first set of vertical lift tracks;

wherein the third and fourth movable members are configured to slide along a horizontal axis within the interior cavity via a second set of railings; and wherein the third and fourth movable members are configured to slide along a vertical axis within the interior cavity via a second set of vertical lift tracks;

a fumigation system configured to release a gaseous substance via one or more fumigation slots;

a sanitation system configured to disinfect content within the interior cavity, the sanitation system having:

one or more light sources configured to emit ultraviolet light;

a sealing system configured to securely close a trash bag;

a controller;

a weight scale configured to measure a load exerted by a trash bag when the trash bag is hung on the first, second, third and fourth hooks;

a power switch; and a power source;

wherein the controller, the display, the camera, the compaction system, the fumigation system, the sanitation system, the sealing system, the weight scale, the power switch, and the power switch are in electronic communication.

2. A method of compacting and sanitizing trash, the method comprising:

providing a trash compactor and sanitation receptacle, the trash compactor and sanitation receptacle comprising:

a housing defining an interior cavity therein, the housing having:

a plurality of side walls;

an open top portion; and a closed bottom portion;

a lid coupled to the open top portion via one or more hinges;

one or more wheels coupled to the closed bottom portion;

a display configured to display a graphical user interface;

a camera coupled to an underside of the lid;

a compaction system configured to condense trash within a trash bag, the compaction system having:

a first movable member coupled to a first corner of the open top portion, the first movable member having a first hook coupled thereto;

a second movable member coupled to a second corner of the open top portion, the second movable member having a second hook coupled thereto;

a third movable member coupled to a third corner of the open top portion, the third movable member having a third hook coupled thereto; and a fourth movable member coupled to a fourth corner of the open top portion, the fourth movable member having a fourth hook coupled thereto;

wherein the first and second movable members are configured to slide along a horizontal axis within the interior cavity via a first set of railings;

wherein the first and second movable members are configured to slide along a vertical axis within the interior cavity via a first set of vertical lift tracks;

wherein the third and fourth movable members are configured to slide along a horizontal axis within the interior cavity via a second set of railings; and wherein the third and fourth movable members are configured to slide along a vertical axis within the interior cavity via a second set of vertical lift tracks;

a fumigation system configured to release a gaseous substance via one or more fumigation slots;

a sanitation system configured to disinfect content within the interior cavity, the sanitation system having:

one or more light sources configured to emit ultraviolet light;

a sealing system configured to securely close a trash bag;

a controller;

a weight scale configured to measure a load exerted by a trash bag when the trash bag is hung on the first, second, third and fourth hooks;

a power switch; and a power source;

wherein the controller, the display, the camera, the compaction system, the fumigation system, the sanitation system, the sealing system, the weight scale, the power switch, and the power switch are in electronic communication;

hanging a trash bag via the first, second, third, and fourth hooks;

placing trash within the trash bag;

measuring load exerted by the trash bag using the weight scale;

condensing the trash within the trash bag via the compaction system;

releasing a gaseous substance via the fumigation system;

disinfecting the interior cavity, the trash, and the trash bag via the sanitation system;

securely closing the trash bag via the sealing system; and removing the closed trash bag for permanent disposal.

* * * * *